US007364051B2

(12) United States Patent
Diaz et al.

(10) Patent No.: US 7,364,051 B2
(45) Date of Patent: Apr. 29, 2008

(54) REMOTE ACTUATOR FOR BALL INJECTOR

(75) Inventors: Juan M. Diaz, Plano, TX (US); F. Rand Underwood, Dallas, TX (US)

(73) Assignee: S.P.M. Flow Control, Inc., Fort Worth, TX (US)

( * ) Notice: Subject to any disclaimer, the term of this patent is extended or adjusted under 35 U.S.C. 154(b) by 601 days.

(21) Appl. No.: 10/785,922

(22) Filed: Feb. 24, 2004

(65) Prior Publication Data

US 2005/0184083 A1 Aug. 25, 2005

(51) Int. Cl.
*G07F 11/16* (2006.01)

(52) U.S. Cl. ..... 221/265

(58) Field of Classification Search ..... 221/265
See application file for complete search history.

(56) References Cited

U.S. PATENT DOCUMENTS 2,875,695 A * 3/1959 Justice ..... 417/320
3,796,093 A * 3/1974 Parkinson ..... 73/862.328
3,961,316 A * 6/1976 Myer ..... 377/89
4,574,644 A * 3/1986 Lew et al. ..... 73/861.05
4,777,830 A * 10/1988 Lew ..... 73/861.75
4,993,365 A * 2/1991 Weerstra ..... 119/71
5,004,981 A * 4/1991 Hashimoto et al. .... 324/207.22
5,248,246 A * 9/1993 Lew et al. ..... 418/4
5,335,579 A * 8/1994 David ..... 89/34
5,513,737 A * 5/1996 Morimoto et al. ..... 193/12
5,520,171 A * 5/1996 David ..... 124/51.1
5,608,278 A * 3/1997 Mey et al. ..... 310/90
5,767,453 A * 6/1998 Wakou et al. ..... 177/25.18
5,947,100 A * 9/1999 Anderson ..... 124/45
6,501,263 B1 * 12/2002 Nyce ..... 324/207.13
2002/0011840 A1 * 1/2002 Li ..... 324/207.21
2002/0101781 A1 * 8/2002 Bump ..... 366/141

* cited by examiner

*Primary Examiner*—Patrick Mackey
*Assistant Examiner*—Michael Butler
(74) *Attorney, Agent, or Firm*—Bracewell & Giuliani LLP

(57) ABSTRACT

An electrical motor rotatably drives a motor shaft, and a helical rib radially extends from the shaft. The helical rib supports a number of balls, and forms a channel to accommodate the balls. The balls are dropped from the helical rib when the balls reach the bottom of the helical rib. Several targets are affixed to the shaft. A sensor is located adjacent to and apart from the shaft, and is positioned in close proximity to the targets. The sensor senses each target as each target rotates past the sensor. The number of targets sensed per revolution of the shaft is equal to the number of balls dropped from the helical rib per revolution of the helical rib. A counter in data communication with the sensor displays the number of targets sensed, and thus displays the number or balls dropped from the helical rib.

11 Claims, 5 Drawing Sheets

REMOTE ACTUATOR FOR BALL INJECTOR

1. FIELD OF THE INVENTION

This invention relates to a remote actuator for injecting spherical balls into an oil well. More particularly, this invention relates to a target and sensor mechanism that effectively counts the number of balls injected into the well.

2. BACKGROUND OF THE INVENTION

When an oil or gas well is completed, it is common practice to cement the well casing into the well. The casing is then perforated to allow fluid from the producing formations to flow into the well bore.

In order to increase the productivity of oil and gas wells, producing formations are sometimes treated by hydraulic fracing and acidizing. Hydraulic treading fluid is pumped into the well bore and exits through the perforations in the casing into the formation.

If some of the perforations are blocked by sediment, or if part of a formation has a lower permeability, part of the formation may not have been treated by fracing. To insure that this does not happen, perforation sealer balls are introduced into the frac fluid. The sealer balls seal the open perforations, thus forcing the treating fluid to flow through the other perforations. Thus, ball injectors have been used in the well service industry as a means of selectively diverting acidizing or fracing fluid to all of a well's perforations.

Several different types of devices have been devised for injecting such balls into a well. These devices must be capable of withstanding the high pressures of the well bore. The devices must also be able to easily and accurately count the number of balls inserted into the well. Sometimes several hundred balls are used, so at times it is very difficult to keep track of the number of balls that have been inserted. It is important that an exact count of balls be accurate at all times.

Prior versions of ball injectors have been used to inject balls into a flowline, in which a mechanical or electrical crank rotates the ball injector device. The ball counting in these versions is handled by a mechanical reed-type switch that engages a cam. The cam thus rotated with the motor shaft. The rotating plate at the bottom had four holes, dropping four balls per one full revolution. The cam had four lobes, thus causing the switch to make a count for each ¼ turn. However, prior versions could not be used, for example, if the operator wished to drop eight balls per full revolution. This resulted from problems such as the inability to readily remove the cam from the device.

3. SUMMARY

The invention provides a motor shaft that is rotatably driven by an electrical motor, and a helical rib that radially extends from the shaft. The helical rib supports a number of balls, and forms a channel to accommodate the balls. The balls are dropped from the helical rib when the balls reach the bottom of the helical rib. Several targets are affixed to the shaft. A sensor is located adjacent to and apart from the shaft, and is positioned in close proximity to the targets. The sensor senses each target as each target rotates past the sensor. The number of targets sensed per revolution of the shaft is equal to the number of balls dropped from the helical rib per revolution of the helical rib. A counter in data communication with the sensor displays the number of targets sensed, and thus displays the number or balls dropped from the helical rib.

The novel features of this invention, as well as the invention itself, will best be understood from the following drawings and detailed description.

4. BRIEF DESCRIPTION OF THE DRAWINGS

5. DETAILED DESCRIPTION OF THE INVENTION

Although the following detailed description contains many specific details for purposes of illustration, anyone of ordinary skill in the art will appreciate that many variations and alterations to the following details are within the scope of the invention. Accordingly, the exemplary embodiment of the invention described below is set forth without any loss of generality to, and without imposing limitations thereon, the claimed invention.

Figure 1:
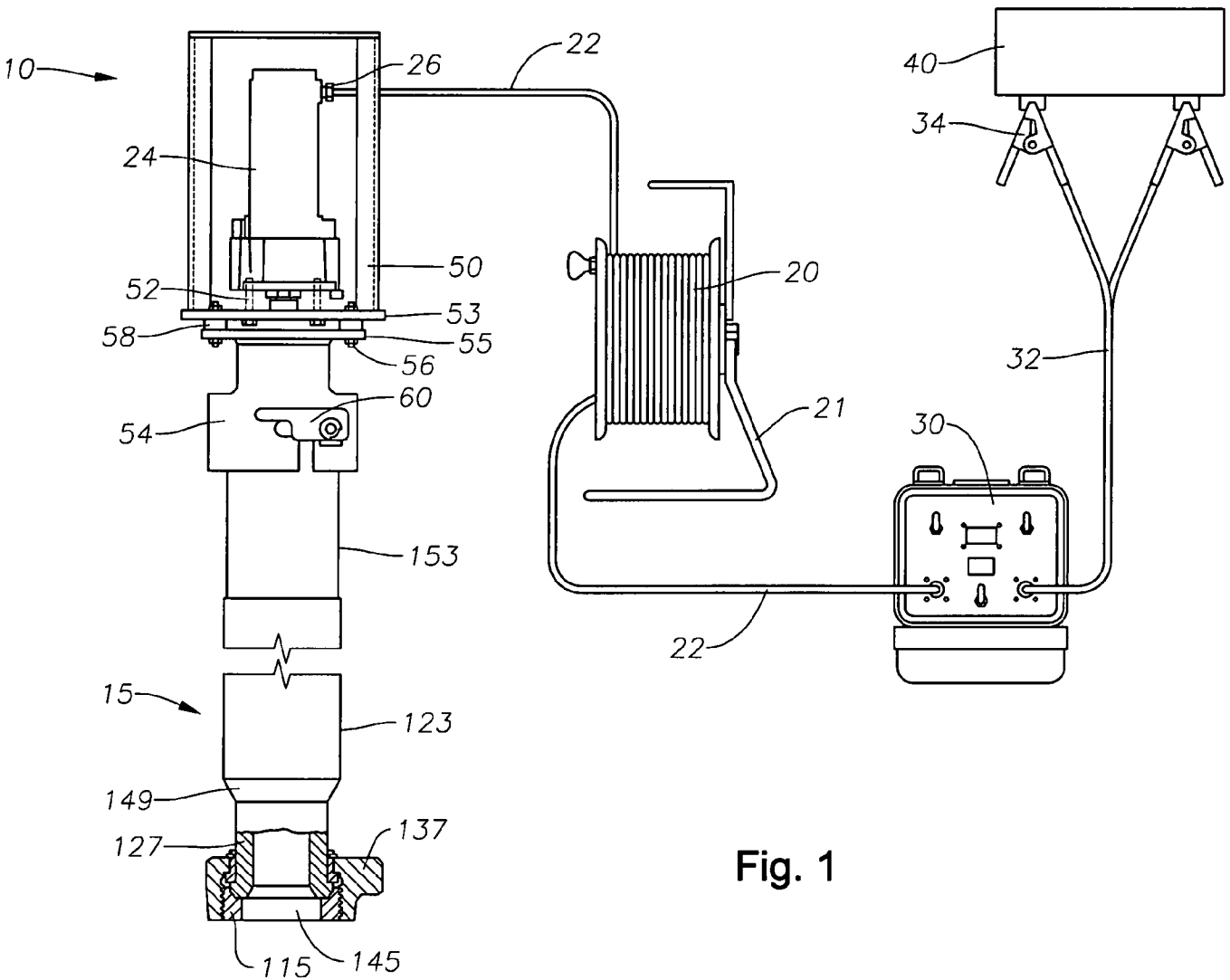
FIG. 1 shows a schematic of all component parts relating to the operation of the remote actuator and the ball injector.

FIG. 1 shows a schematic of all component parts relating to the operation of the remote actuator 10 and the ball injector 15. A cable reel 20, which is supported by a reel stand 21, comprises a roll of control cable 22. To assemble the remote actuator system 10 for operation, the control cable 22 is unrolled from one end of the cable reel 20 and connected to an electric motor 24 by fastener 26. Then the control cable 22 is unrolled from the other end of the cable reel 20 and connected to the output port of the control panel 30. The length of control cable typically is 150 feet. A power cable 32 is connected at one end to the input port of the control panel 30, and features a pair of clamps 34 at the other end of the power cable 32. The length of power cable 32 typically is 20 feet. The clamps 34 are then connected to the power source 40. The 12 Volt DC power source 40 supplies 65 Watts, or 0.09 Horsepower to the remote actuator 10 in one embodiment.

The motor 24 is housed inside a motor housing 50. The motor 24 is preferably an electrical motor, but alternatively may be a manual crank. The motor 24 rests inside the motor housing 50, above the mounting plate 53, and is attached by a series of screws 52. The screws 52 attach the bottom end of the motor 24 to the mounting plate 53. A flange 54 is fastened to the motor housing 50, below the mounting plate 53, by a series of bolts 56. The bolts 56 attach the mounting plate 53 to a base plate 55 on the upper portion of the flange 54. To prevent metal-on-metal contact between the mounting plate 53 of the motor housing 50 and the base plate 55 of the flange 54, a rubber spacer 58 is placed in between the mounting plate 53 and the base plate 55. The bolts 56 extend through the spacer 58 to secure the flange 54 to the motor housing 50.

The flange 54 is designed to cover the upper end of the ball injector 15, allowing the bottom part of the motor 24 to connect with the upper end of the ball injector 15, which is conventional. The upper end of the ball injector 15 features a ball injector housing 153, having a diameter smaller than the diameter of the flange 54, so that the upper end of the ball injector 15 can fit inside the flange 54. The flange 54 allows the ball injector 15 to connect with the motor 24, so that the motor 24 can provide the torque necessary to properly operate the ball injector 15. The flange 54 also serves the purpose of stabilizing the remote actuator system 10. A locking lever 60 locks the flange 54 to the upper end of the ball injector 15 to stabilize the system. The flange 54 further sustains proper alignment between the component parts of the remote actuator system 10. The motor 24, the flange 54, and the ball injector 15 each share the same center axis.

Figure 2:
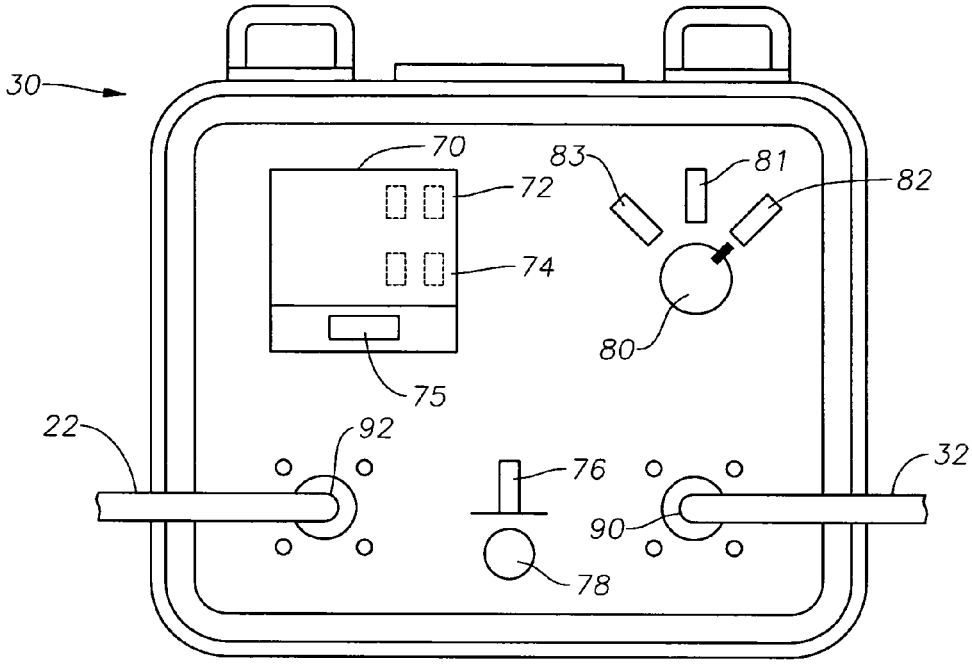
FIG. 2 shows a control panel as demonstrated in FIG. 1

Referring to FIG. 2, the control panel 30 has various functions. The control panel 30 features a counter 70, which has a display 72 of the number of balls remaining to drop, and a display 74 of the number of balls that have been dropped. The counter 70 also has a counter reset button 75. The control panel 30 has an on/off button 76 and power indicator 78. The operator uses a control switch 80 to direct the remote actuator system 10 to a run position 81, a stop position, 82 or a reverse position 83. These features are situated on the control panel 30 in a manner so that they are simple to understand and easy to operate. The control panel 30 also features an input port 90 to receive the power cable 32, and an output port 92 to receive the control cable 22.

Figure 3:
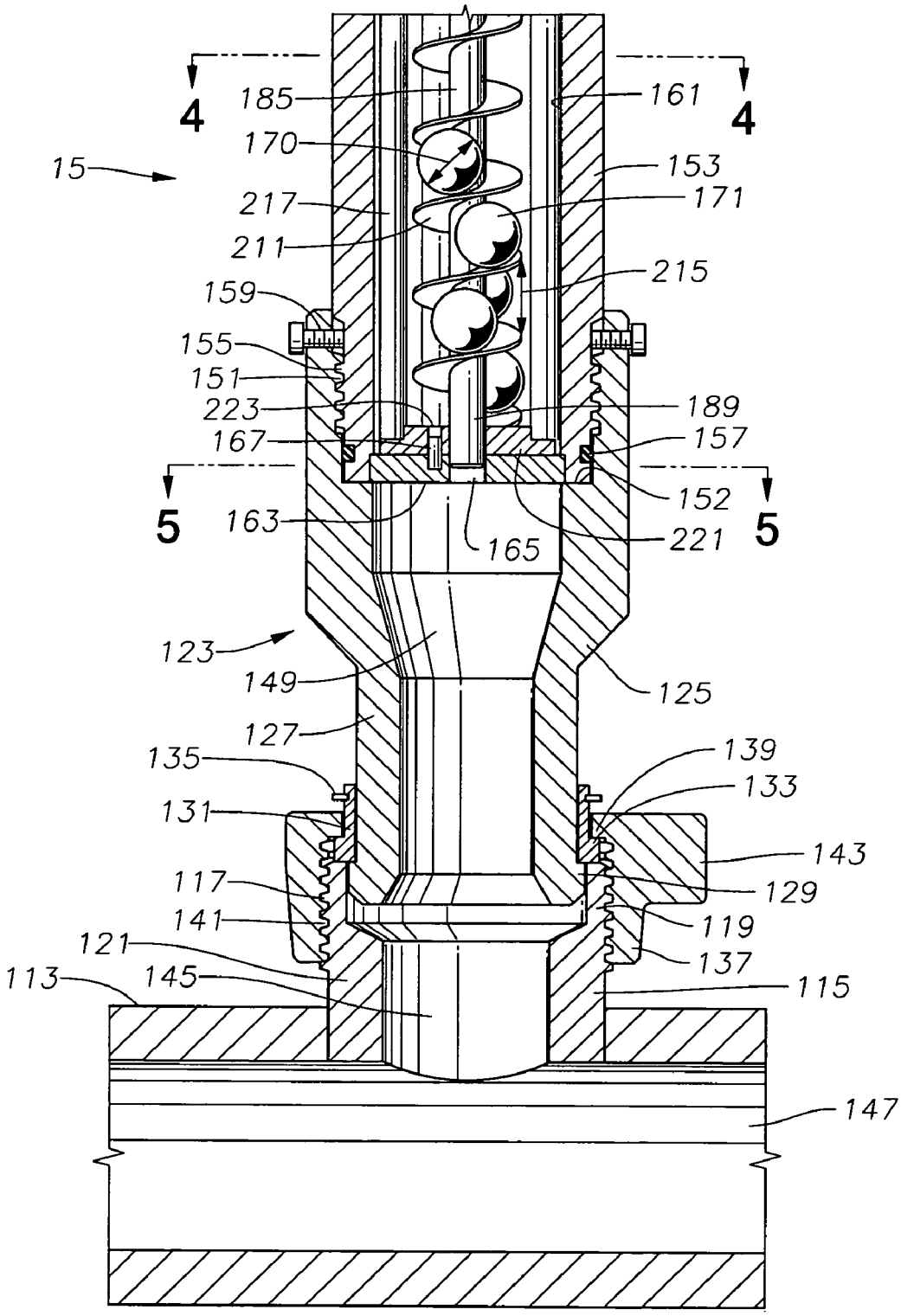
Fig. 3 (Prior Art)
FIG. 3 shows a sectional view of the bottom end of a ball injector connected to a flowline.

FIG. 3 shows a ball injector 15 connected to a flow line 113, which leads to the bore hole of the well (not shown). The flow line 113 has an upwardly extending tee 115, which has external threads 117. The upper section 119 of the tee 115 has an inner diameter which is larger than the inner diameter of the lower section 121 of the tee 115.

The lower end of the ball injector 15 is a generally cylindrical nose 123, having an upper section 125 and a lower section 127. The lower section 127 of the nose 123 has a smaller outside diameter, and an outwardly extending lip 129. The lip 129 has a diameter which is slightly smaller than the inner diameter of the upper section 119 of the tee 115, so that the lip 129 and the lower section 127 of the nose 123 fit within the tee 115. Three ring sections 131 fit around the lower section 127 of the nose 123, above the outwardly extending lip 129. These ring sections 131 also have an outwardly extending lip 133 on the lower end. A retainer ring 135 is located near the upper end of the ring sections 133.

A nut 137 connects the ball injector 15 to the tee 115. The nut 137 has an inwardly extending shoulder 139, which contacts the outwardly extending lip 133 on the ring sections 131. The nut 137 also has threads 141 which engage the threads 117 on the tee 115. The ball injector 15 can be removed from the tee 115 by unthreading the nut 137. A lug 143 on the nut 137 facilitates the threading and unthreading of the nut 137.

The tee 115 has bore 145, which intersects the bore 147 of the flow line 113. The cylindrical nose 123 also has a bore 149, which is in fluid communication with the bore 145 of the tee 115 and the bore 147 of the flow line 113. The bore 149 of the nose 123 tapers, so that the bore 149 has a larger diameter in the upper section 125 of the nose 123 than in the lower section 127.

Near the upper end of the nose 123, the bore 149 abruptly enlarges, forming an upwardly facing shoulder 152 inside arm 125. Above this shoulder 152, the nose 123 has internal threads 151. Above the nose 123, the ball injector 15 has a cylindrical ball injector housing 153. The lower end of the ball injector housing 153 abuts the shoulder 152 in the nose 123, and has external threads 155, which engage the internal threads 151 in the upper end of the nose 123. An O-ring seal 157 seals between the ball injector housing 153 and the nose 123. Two set screws 159 extend through the nose 123 and engage the ball injector housing 153, to hold the ball injector housing 153 against unthreading from the nose 123.

Figure 4:
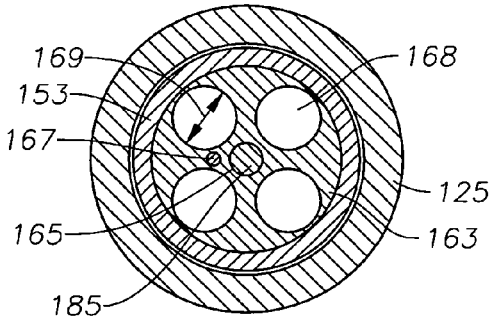
Fig. 4 (Prior Art)
FIG. 4 shows a sectional view of the ball injector as seen along line 4-4 of FIG. 2.
Figure 5:
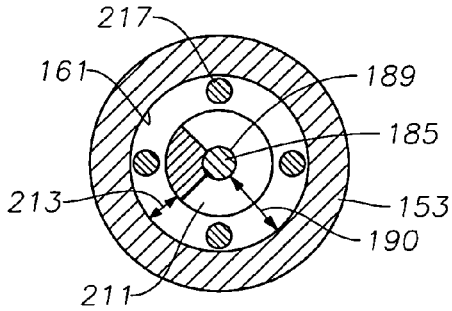
Fig. 5 (Prior Art)
FIG. 5 shows a sectional view of the ball injector as seen along line 5-5 of FIG. 2.

Referring to FIGS. 3-5, the ball injector housing 153 is a hollow cylinder, having a smooth, cylindrical inner surface 161. A bottom plate 163 is mounted at the lower end of the ball injector housing 153. A circular hole 165 is located in the center of the bottom plate 163. The bottom plate 163 has an upwardly extending retainer pin 167, located near the center hole 165. The bottom plate 163 also has four circular holes 168, equally spaced around the bottom plate 163. The diameter 169 of these holes 168 is slightly larger than the diameter 170 of the balls 171.

At times, the operator may desire to have a greater or lesser number of balls 171 delivered from the ball injector 15 into the well, or the operator may desire to drop balls 171 having larger or smaller sizes. The capacity of balls 171 capable of being stored in the ball injector 15 is dependent upon the respective sizes of the balls 171. The smaller the diameter of the balls 171, the greater the number of balls 171 dropped into the well. Conversely, the larger the diameter of the balls 171, the fewer number of balls 171 delivered. If a greater or lesser number of balls 171 is desired to be delivered from the ball injector 15, the operator simply replaces the bottom plate 163 with a different bottom plate 163 having circular holes 168 of a larger or smaller diameter 169.

In this respect, the ball injector's 15 unique "positive feed system" eliminates the need for multiple units to handle different size balls 171. One unit 15 handles as many as six different ball 171 sizes. The ball injector 15 can accommodate balls 171 with sizes of ⅝", ¾", ⅞", 1", 1⅛", and 1¼" diameters 170. Balls 171 of diameters 170 of ⅝" and ¾" result in a capacity of one hundred sixty five (165) balls 171 in the ball injector 15. Balls 171 of diameters ⅞" and 1" fill a capacity of one hundred thirty (130) balls 171. Balls of 1⅛" and 1¼" fill a capacity of one hundred (100) balls 171. Various replaceable cartridges for the bottom plate 163, which has circular holes 168 with a diameter 169 slightly larger than the diameter 170 of the balls 171, are designed to accommodate balls 171 of the aforementioned sizes.

In order to change out the bottom plate 163 and replace it with a bottom plate 163 with different sized circular holes 168, the set screws 159 are unscrewed and disengaged from the ball injector housing 153. The ball injector housing 153 is then unthreaded from the nose 123, and removed from the nose 123. The operator accesses the bottom end of the ball injector housing 153, and disengages the bottom plate 163 from the housing 153, and replaces it with a different bottom plate 163 having a different number and diameter circular holes 168. After installing the new bottom plate 163 onto the bottom end of the ball injector housing 153, the housing 153 is then re-screwed into the nose 123 through engagement of threads 151 with threads 155. Finally, the set screws 159 are re-screwed and re-engaged with the ball injector housing 153.

A ball injector shaft 185 is mounted coaxially within the ball injector housing 153, so that the ball injector housing 153 and the ball injector shaft 185 have the same longitudinal axis. The ball injector shaft 185 has a smooth, cylindrical outer surface 189, and the lower end of the ball injector shaft 185 fits within the circular hole 165 in the bottom plate 163 of the ball injector housing 153. The distance between the inner surface 161 of the ball injector housing 153 and the outer surface 189 of the ball injector shaft 185 is greater than the diameter 170 of the balls 171, so the balls 171 can fit between the ball injector shaft 185 and the ball injector housing 153.

A helical rib 211 is rigidly mounted on the outer surface 189 of the ball injector shaft 185. The rib 211 spirals downward to the right, so that when the motor 24 drives the ball injector shaft 185 counterclockwise, the rib 211 will move the balls 171 downward. The distance 213 between the outer edge of rib 211 and the inner surface 161 of the housing 153 is smaller than the diameter 170 of the balls 171. This keeps the balls 171 from falling between the rib 211 and the housing 153. The pitch 215 of the rib 211 is slightly larger than the diameter 170 of the balls 171 so that the balls 171 fit within the rib 211.

Also located within the housing 153 are four cylindrical rods 217. The rods 217 are equally spaced around and parallel with the ball injector shaft 185. In the embodiment shown, the rods 217 are cylindrical. The distance 219 between the inner sides of the rods 217 and the outer surface 189 of the ball injector shaft 185 is smaller than the diameter 170 of the balls 171. Thus, the rods 217 keep the balls 171 from rolling around the ball injector shaft 185 down the rib 211.

The lower ends of the rods 217 are welded into a lower guide plate 221. The lower guide plate 221 has a small hole 223, into which the retainer pin 167 on the bottom plate 163 of the housing 153 fits. The retainer pin 167 thus aligns the lower guide plate 221 and holds the rods 217 against rotation about the longitudinal axis of the housing 153.

When the ball injector 15 is being used to insert balls 171 into the flow line 113, the ball injector 15 is mounted on the tee 115. The balls 171 are contained in the housing 153 in four vertical columns, one column being against each rod 217. The threads of the rib 211 separate the balls 171 in each column.

As the motor 24 turns the ball injector shaft 185 counterclockwise, the rib 211 rotates, and pushes the balls 171 downward. As each ball 171 reaches the bottom plate 163, the ball 171 falls through one of the holes 168 in the bottom plate 163, through the bore 149 of the nose 123 and the bore 145 of the tee 115, into the bore 147 of the flow line 113. Each time a ball 171 is released, the counter 70 counts the ball 171.

Figure 6:
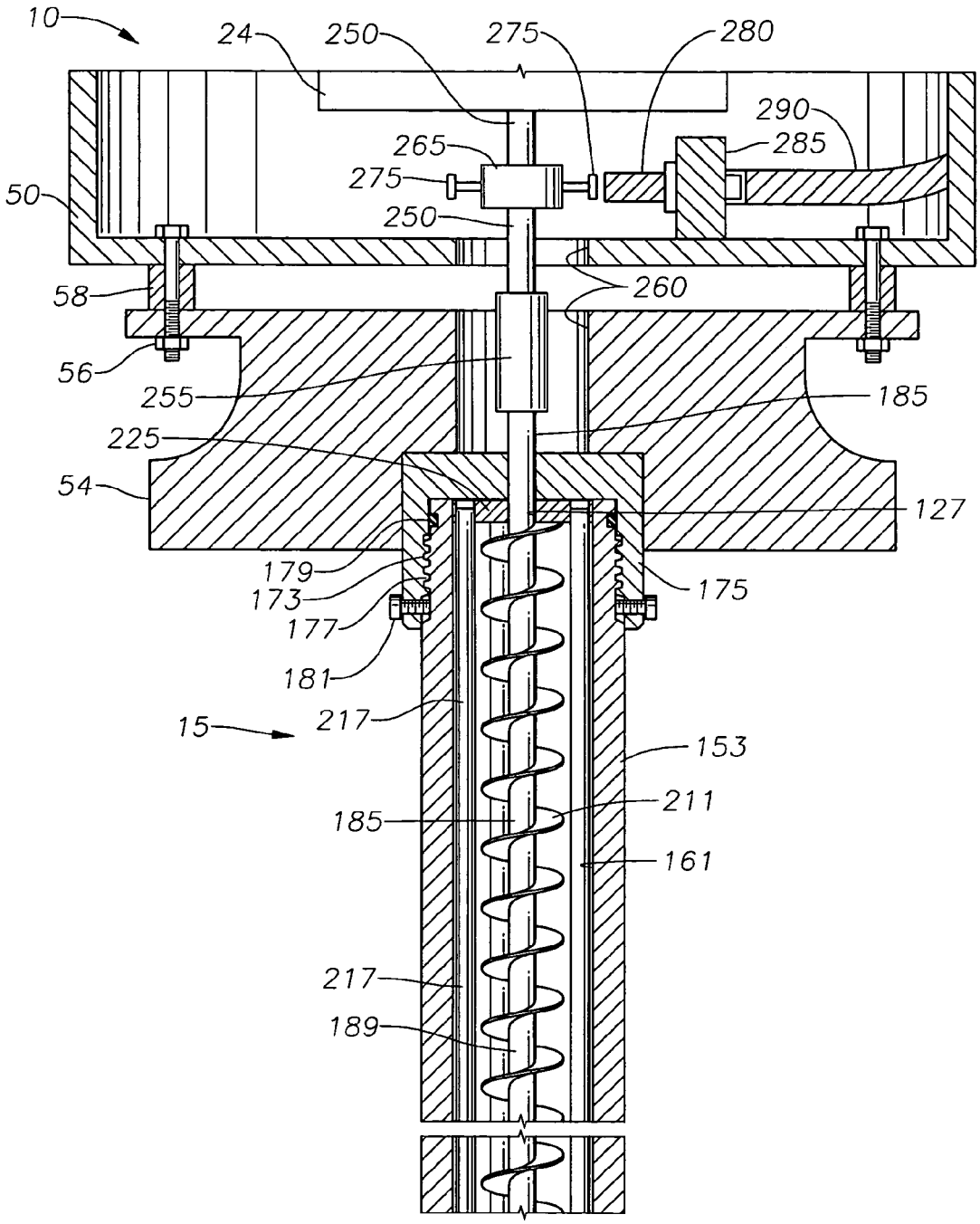
FIG. 6 shows a sectional view of the upper end of a ball injector connected to a remote actuator in accordance with the invention.

Referring to FIG. 6, the upper end of the ball injector housing 153 has external threads 173, and is closed by a lid 175. The lid 175 has internal threads 177 to engage the external threads 173 on the ball injector housing 153. An O-ring seal 179 seals between the lid 175 and the ball injector housing 153, and two set screws 181 hold the lid 175 against unthreading from the ball injector housing 153. The upper ends of the rods 217 are welded into an upper guide plate 225. The ball injector shaft 185 extends through a circular hole in the upper guide plate 225. The flange 54 covers the lid 175 and the ball injector housing 153.

The upper end of the ball injector shaft 185 extends upward through the lid 175, and attaches to the bottom end of a motor shaft 250 by a connector 255. Both the ball injector shaft 185 and the motor shaft 250 may be thought of or referred to as a single shaft. The ball injector shaft 185, the motor shaft 250, and the connector 255 all share the same center axis. The flange 54 and the mounting plate 53 of the motor housing 50 have a cylindrical opening at its center, with an inside wall 260 having a diameter greater than the diameter or thickness of the ball injector shaft 185, the motor shaft 250, and the connector 255. The cylindrical opening allows the ball injector shaft 185, the motor shaft 250, and the connector 255 to extend upward from the ball injector 15 into the motor 24.

The motor 24 and motor shaft 250 are coaxially mounted within the motor housing 50. The motor shaft 250 cross section is preferably ⅜ inches hex or 7/16 inches square. The nominal torque provided by the motor 24 is 220 in-lbs, but may peak at 250 in-lbs for ⅜ inch motor shaft 250 cross sections and 450 in-lbs for 7/16 inch motor shaft 250 cross sections. This allows the flexibility to drive various ball injector 15 sizes, where the sizes of the balls 171 may range from ⅝ inches to 1¼ inches in diameter. If the power source 40 provides 65 Watts, the resultant nominal speed of the motor shaft 250 is 25 revolutions per minute (RPM). A DC controller (not shown) monitors and protects the motor 24 and motor shaft 250, and provides overall smoother operation of the remote actuator 10.

Figure 7:
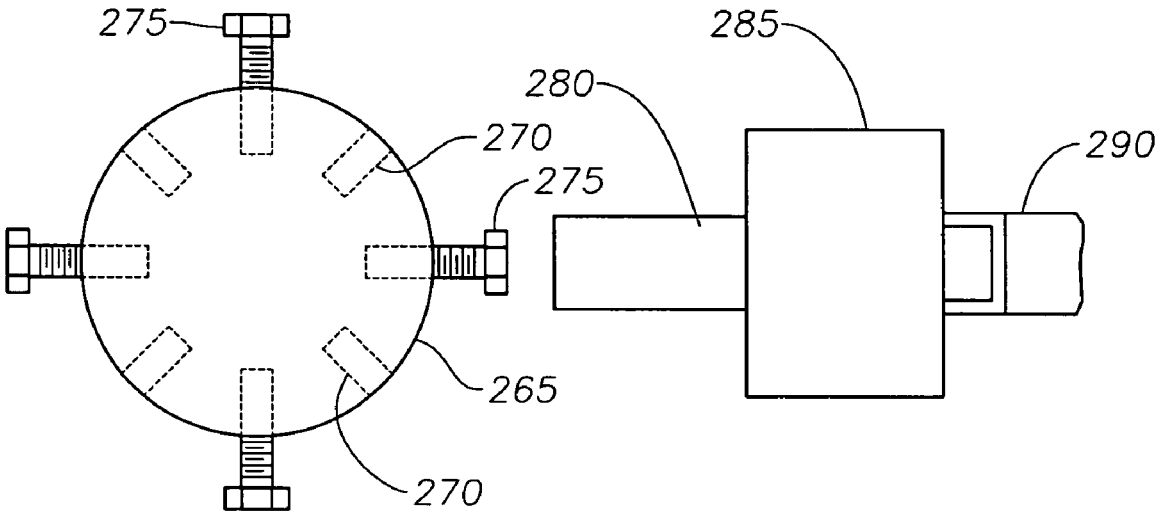
FIG. 7 shows a top view of the proximity sensor and targets in accordance with the invention.

Referring to FIGS. 6 and 7, a cylindrical target receptacle 265 is located on the motor shaft 250, between the connector 255 and the motor 24. The target receptacle 265 features cylindrical threaded recesses 270 on the outer cylindrical surface of the target receptacle 265. The recesses 270 extend inward through the target receptacle 265 toward the center axis.

The recesses 270 are designed to accommodate targets 275, which are typically in the form of metal bolts. The targets 275 are threaded to accede to the threads of the recesses 270, and have an outer diameter that is substantially equal to the diameter of the cylindrical recesses 270 in the target receptacle 265. The targets 275 simply screw into the recesses 270 of the target receptacle 265 for easy assembly and disassembly. When the targets 275 are fully screwed into the recesses 270, the targets 275 protrude somewhat from the target receptacle 265. The recesses 270 and targets 275 are designed so that all targets 275 screwed into the target receptacle 265 protrude outward the same distance from the target receptacle 265.

The recesses 270, and thereby the targets 275, are aligned to extend at similar distances or angles from each other around the target receptacle 265. For example, if four recesses 270 contain four targets 275, then each recess 270 and target 275 is positioned 90 degrees from one another. If eight recesses 270 contain eight targets 275, then each recess 270 and target 275 is positioned 45 degrees from one another. In the embodiment shown in FIG. 7, whereby eight recesses 270 collectively hold four targets 275, then each recess 270 is 45 degrees from the next adjacent recess 270, and each target 275 is 90 degrees from the next adjacent target 275. Each target 275 is on a radial line of the axis of the target receptacle 265.

A single proximity sensor 280 and corresponding sensor support 285 are located on the mounting plate 53 of the motor housing 50, on one side of the motor shaft 250. The bottom of the sensor support 285 is affixed to the upper side of the mounting plate 53. The proximity sensor 280 is fastened to the side of the sensor support 285 facing the motor shaft 250 and center axis. As such, the proximity sensor 280 extends from the sensor support 285 inward toward the motor shaft 250 and the center axis. The proximity sensor 280 has a length such that when a target 275 protruding from the target receptacle 265 is directly in-line and facing the proximity sensor 280, the proximity sensor 280 extends into close proximity with, but does not touch, the target 275.

The proximity sensor 280 is a conventional unit that provides a magnetic field, which is designed to detect when any metal bolt target 275 approaches into close proximity with and rotates past the proximity sensor 280. A sensor transmitter 290 extends from the opposite side of the sensor support 285 from which the proximity sensor 280 was positioned. The sensor transmitter 290 transmits the data received from the proximity sensor 280 to the counter 70 of the control panel 30, which effectively reflects the accurate ball count for the operator to view.

In operation, after the on/off switch 76 is turned to the "on" position, the counter 70 powers up. Then the number of balls 171 to be dropped is set on the counter 70. As the motor 24 turns the motor shaft 250, the targets 275 in the target receptacle 265 rotate in a counterclockwise fashion about the axis of the motor shaft 250. As each target 275 rotates past the proximity sensor 280, the proximity sensor 280 senses the head of each bolt target 275 and sends a response to the counter 70 on the control panel 30. Once the counter 70 has reached the total number of balls 171 to be dropped, the on/off switch 76 is turned to the "off" position, and the reset button 75 is pressed on the counter 70.

In a first embodiment of the remote actuator system 10, as shown in FIGS. 4 and 7, where the bottom plate 163 of the ball injector 15 has four circular holes 168 and where only four of the recesses 270 in the target receptacle 265 contain targets 275, the ball injector 15 operates with a delivery of four balls 171 per revolution and the counter 70 similarly counts four balls 171 per revolution. Therefore, if the nominal output speed is 25 RPM at 220 in-lbs. of torque, a ball injector 15 that delivers four balls 171 per revolution can inject one hundred balls 171 per minute. If required, the speed can be re-adjusted to a lower RPM, resulting in fewer balls 171 per minute injected into the well.

Alternative embodiments exist that demonstrate that the remote actuator system 10 in fact operates as a convertible actuator. In one alternative embodiment, the operator switches out the bottom plate 163 of the ball injector 15 and replaces it with a bottom plate 163 that has eight circular holes 168, and the operator simply screws four more targets 275 into the remaining four recesses 270 in the target receptacle 265 shown in FIG. 7 to establish a total of eight targets 275 in the target receptacle 265. As a result, the ball injector 15 operates with a delivery of eight balls 171 per revolution and the counter 70 similarly counts eight balls 171 per revolution. Therefore, if the nominal output speed is 25 RPM at 220 in-lbs. of torque, a ball injector 15 that delivers eight balls 171 per revolution can inject two hundred balls 171 per minute. Alternatively, actuator system 10 can be mounted on different ball injectors 15, each delivering different numbers of balls 171 per revolution.

This invention offers several important advantages. The proximity sensor 280 and targets 275 enable precise counting of balls 171 injected into the well. The remote actuator device 10 operates as a convertible actuator. For example, the actuator 10 can operate with the standard four balls 171 per revolution, with eight balls 171 per revolution, or with other numbers, which offers advantages in contradistinction to the prior cam and switch design. The proximity sensor 280 extends product life by eliminating the mechanical fatigue experienced through prior cam and switch designs. Cost savings are realized by eliminating the need for a mechanical torque limiter. The remote actuator 10 and ball injector 15 comprises heavy duty equipment that is portable, and offers easy assembly and disassembly. The invention ultimately provides higher torque and higher speed at a lower cost while extending the effective life of the system 10.

Although the present invention and its advantages has been described in detail, it should be understood that various changes, substitutions, and alterations can be made hereupon without departing from the principle and scope of the invention. Accordingly, the scope of the present invention should be determined by the following claims and their appropriate legal equivalents.

That which is claimed is:

1. An apparatus for counting a plurality of balls, comprising:

a shaft rotatably driven by an electrical motor;

a helical rib radially extending from the shaft and adapted to support the balls, wherein the balls are dropped from the helical rib when the balls reach the bottom of the helical rib;

a plurality of target mounts spaced circumferentially around the shaft;

a selected number of targets, each of the targets releasably affixed to one of the target mounts on the shaft;

a sensor adjacent to and apart from the shaft, and positioned in close proximity to the targets, wherein the sensor senses each target as each target rotates past the sensor, and wherein the number of targets sensed per revolution of the shaft is equal to the number of balls dropped from the helical rib per revolution of the helical rib; and a counter in data communication with the sensor, wherein the counter counts the number of targets sensed.

2. The apparatus of claim 1, wherein the targets protrude from the shaft.

3. The apparatus of claim 1, wherein the targets comprise members of ferrous metal, and wherein the sensor is a magnetic field sensor.

4. The apparatus of claim 1, wherein the targets on the shaft radially extend from an axis of the shaft.

5. The apparatus of claim 1, wherein the targets comprise heads formed on threaded members, and the target mounts comprise threaded holes in the shaft.

6. The apparatus of claim 5, wherein the number of threaded holes in the shaft is greater than or equal to the number of targets secured to the shaft.

7. The apparatus of claim 1, further comprising:

a replaceable bottom plate having holes and stationarily positioned at the bottom of the helical rib to receive and drop the balls;

a plurality of rods spaced circumferentially around the helical rib parallel to the shaft for trapping the balls between adjacent ones of the rods and preventing the balls from rolling down the helical rib; and wherein the number of targets selected to be secured to the target mounts equals the number of holes in the bottom plate.

8. The apparatus of claim 1, wherein the targets comprise heads formed on threaded members, and the target mounts comprise threaded holes in the shaft.

9. An apparatus for counting a plurality of balls, comprising:

a cylindrical housing;

a shaft located concentrically within the housing and rotatably driven by an electrical motor;

a helical rib radially extending from the shaft for rotation therewith;

a replaceable bottom plate in the housing at a lower end of the shaft, the bottom plate having a selected number of apertures therein and spaced circumferentially around the shaft, the shaft being rotatable relative to the bottom plate, for dropping balls through the apertures in the bottom plate as the shaft rotates;

a plurality of rods spaced around the rib within the housing, the rods being parallel to the shaft and stationarily mounted in the housing to prevent the balls from rolling down the rib;

a plurality of target mounts spaced circumferentially around the shaft;

a plurality of targets, each of the targets releasably affixed to one of the target mounts, the number of the targets equaling the number of apertures in the bottom plate; and a sensor adjacent to and apart from the shaft, and positioned in close proximity to the targets, wherein the sensor senses each target as each target rotates past the sensor, and wherein the number of targets sensed per revolution of the shaft is equal to the number of balls dropped from the helical rib per revolution of the helical rib.

10. The apparatus of claim 9, wherein the targets protrude from the shaft.

11. An apparatus for counting a plurality of balls, comprising:

a shaft rotatably driven by an electrical motor;

a helical rib radially extending from the shaft and adapted to support the balls, wherein the balls are dropped from the helical rib when the balls reach the bottom of the helical rib;

a plurality of threaded holes formed in the shaft and spaced circumferentially apart from each other;

a plurality of threaded members, each having a head thereon that is formed of a ferrous metal, the threaded members being secured to the threaded holes in the shaft;

a magnetic sensor adjacent to and apart from the shaft, and positioned in close proximity to the heads of the threaded members, wherein the sensor senses each head as each head rotates past the sensor, and wherein the number of heads sensed per revolution of the shaft is equal to the number of balls dropped from the helical rib per revolution of the helical rib; and a counter in data communication with the sensor, wherein the counter counts the number of heads sensed.

* * * * *